US005370561A

United States Patent [19]

Jakobsen

[11] Patent Number: 5,370,561

[45] Date of Patent: Dec. 6, 1994

[54] PROPULSION DEVICE FOR A WATERCRAFT

[76] Inventor: Einar Jakobsen, Roven, N-1920 Sorumsand, Norway

[21] Appl. No.: 859,396

[22] PCT Filed: Nov. 30, 1990

[86] PCT No.: PCT/NO90/00179

§ 371 Date: May 28, 1992

§ 102(e) Date: May 28, 1992

[87] PCT Pub. No.: WO91/08139

PCT Pub. Date: Jun. 13, 1991

[30] Foreign Application Priority Data

Dec. 4, 1989 [NO] Norway ..... 894844

[51] Int. Cl.[5] ..... B63H 1/36

[52] U.S. Cl. ..... 440/14; 244/72

[58] Field of Search ..... 440/9, 13, 14, 15, 17, 440/20, 21, 93, 94; 244/11, 22, 72; 416/79-83

[56] References Cited

U.S. PATENT DOCUMENTS 3,215,371 11/1965 Schmidt ..... 416/83
4,371,347 2/1983 Jakobsen ..... 440/9

FOREIGN PATENT DOCUMENTS 866764 12/1952 Germany .
3014584 12/1980 Germany .
977272 6/1982 U.S.S.R. .
1331726 8/1987 U.S.S.R. .
1595741 9/1990 U.S.S.R. ..... 440/93

*Primary Examiner*—Edwin L. Swinehart
*Attorney, Agent, or Firm*—Sughrue, Mion, Zinn, Macpeak & Seas

[57] ABSTRACT

A propulsion device for a floating structure, especially a watercraft, includes an essentially horizontally disposed wing which is rotatably connected to the craft and is arranged to carry out a tilting movement and provide for propulsion of the craft by relative vertical movement between the wing and the surrounding water. The wing is mounted in such a manner as to be capable of turning 360° about its tilting axis, the tilting axis being located at or somewhat ahead of the balance point for lift of the wing, as viewed in the horizontal direction in which the craft is moving. A system for returning the wing towards a neutral horizontal position after the wing has angularly deviated therefrom includes a control system which, based upon a signal received from a position detector, controls a motor that exerts torque on the wing in the direction towards the neutral position.

11 Claims, 2 Drawing Sheets

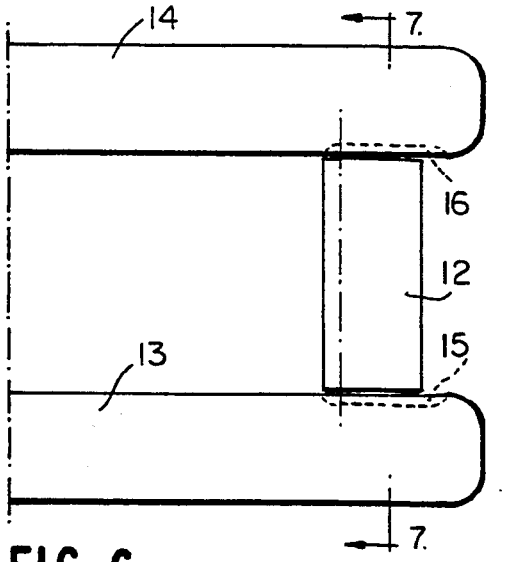
FIG.6
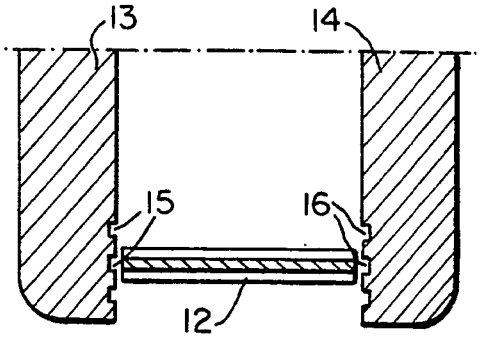
FIG.7
FIG.8
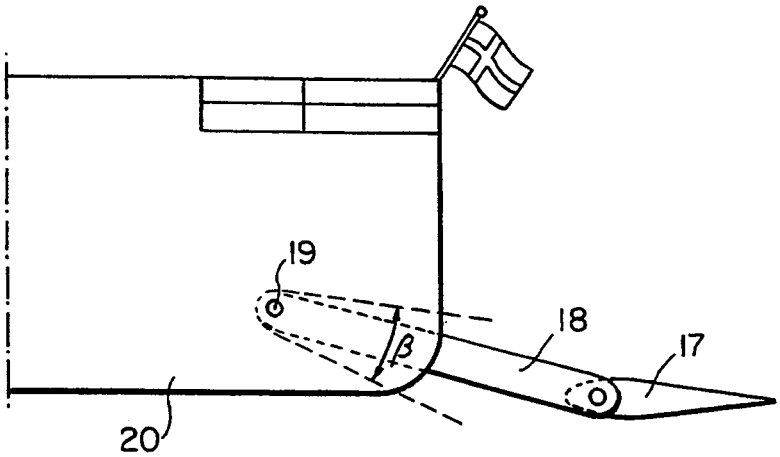
FIG.9
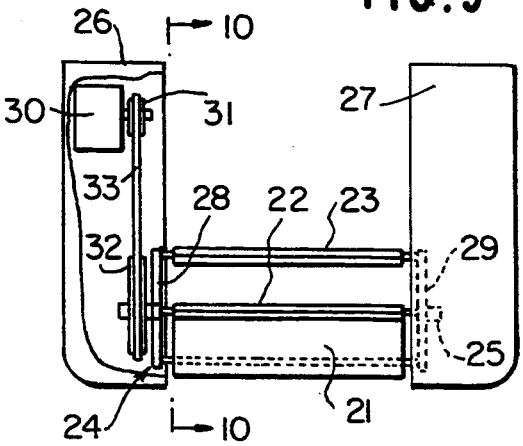
FIG.10
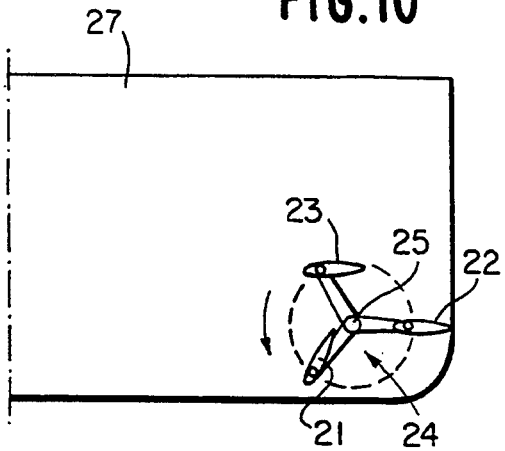

PROPULSION DEVICE FOR A WATERCRAFT

The present invention relates to a propulsion device for a floating structure, especially a watercraft, comprising at least one essentially horizontally disposed, plate-like wing which is rotatably connected to the craft and is arranged to carry out a tilting movement to each side of a neutral position, to provide for propulsion of the craft by relative vertical movement between the wing and the surrounding water.

BACKGROUND OF THE INVENTION

There are previously known many different variants of propulsion devices of the above-mentioned type. For example, the U.S. Pat. Nos. 2,021,815 and 2,367,765 show propulsion devices for a watercraft wherein vertical movement of the craft is transferred to the plate-like wing or foil through a carrier structure for the wing, the wing being pivotable about a shaft attached to the carrier structure. The excursion angle of the wing is limited by mechanical stops placed on the carrier structure.

The devices according to said U.S. patents are not capable of utilizing small vertical movements of the craft, since the wing must have such large excursions as to bear against the stop before propulsion force can be obtained. For really large vertical movements the wing will stall, and great eddy formations around the wing will cause losses and little efficient propulsion.

U.S. Pat. No. 4,332,571 shows an improved construction in relation to the two above-mentioned U.S. patents. In the wave motor according to this patent there are used steel springs or hydraulic/pneumatic cylinders with e.g. gas pressure in order to exert forces trying to return the wing to its neutral horizontal position when making excursions from its neutral position in case of relative movement between water and wing. In this construction, also small vertical movements can be utilized, as well as the large movements which might occur, since the wing can operate with all excursion angles up to ±90°.

U.S. Pat. No. 4,371,347 shows a propulsion device having a wing driven by waves and/or motor force, and wherein a carrier structure for the wing is vertically movable in relation to the watercraft. The carrier structure has a neutral central position, and springs or hydraulics try to bring it back to this position if it has been brought out from this position because of a large vertical movement of the craft. The wing is mounted at the lower end of the carrier structure and is provided with stops for limitation of its angular excursion. This device primarily is intended to provide propulsion by means of wave energy, but it may also be utilized to provide propulsion by means of a motor in that the carrier structure and the associated wing are driven up and down by means of motor force.

A common weakness of the known propulsion devices of the type in question is that they lack the possibility of reversing the propulsion direction of the driven watercraft. This is particularly important if the craft gets its propulsion from a wing (or wings) and wave energy only. However, a topical field of use is also the utilization of wave energy as a supplementary propulsion for boats and ships driven by a conventional motor-driven screw propeller. Less motor power is then necessary in order to maintain the same speed, and thereby one economizes on fuel. A watercraft which is equipped with wings according to said known principles, will have problems when it is going to reverse with its screw propeller. When the water flow starts coming in from behind adjacent to said wings, these will swing out and cause a strong braking of the movement of the craft backwards. The wings will also be subjected to extreme forces, and damage of the wings and their carrier structures is a possibility.

SUMMARY OF THE INVENTION

The object of the invention is to provide a propulsion device of the type in question wherein the above-mentioned deficiencies and drawbacks are eliminated.

The above mentioned object is achieved with a propulsion device of the introductorily stated type which, according to the invention, is characterized in that the wing is mounted in such a manner as to be capable of turning 360° about its tilting axis, the tilting axis being located at or somewhat ahead of the balance point for lift of the wing, as viewed in the propulsion direction.

The invention is based on the recognition that the wing or foil, when the tilting axis is placed at or somewhat ahead of the balance point for lift of the wing, will continuously assume the most favorable angle relative to the water current, and one will then obtain an efficient propulsion by relative vertical movement between the wing and the surrounding water, without the use of mechanical stops. The fact is that the balance point for lift will move backwards on the wing if the angle of attack between the wing and the water current becomes too large, so that the wing approaches stalling. Thereby the wing will again reduce its angle of attack and operate properly.

Relative vertical movement between the water and the wing may be achieved in several ways:

A. By the heave, pitch and roll movements of the craft (boat), wave energy then being utilized for the propulsion of the craft.

B. By placing the wing so that it is influenced directly by vertical movements of waves.

C. By driving the wing up and down in relation to the surrounding water by means of motor or muscular power.

D. A combination of A, B, C.

BRIEF DESCRIPTION OF THE DRAWINGS

The invention will be further described below in connection with exemplary embodiments with reference to the accompanying drawings, wherein

FIG. 6 shows a schematic plan view of an embodiment wherein the wing is mounted in connection with a catamaran type hull;

FIG. 7 shows a sectional view along the line VII—VII in FIG. 6;

FIG. 8 shows schematically an embodiment wherein the wing is used as a motor-driven propulsion means;

FIG. 9 shows a schematical view of a catamaran hull of a vessel seen from behind, wherein the vessel is equipped with three motor-driven wings; and FIG. 10 shows a sectional view along the line X—X in FIG. 9.

DESCRIPTION OF THE PREFERRED EMBODIMENTS

Figure 1:
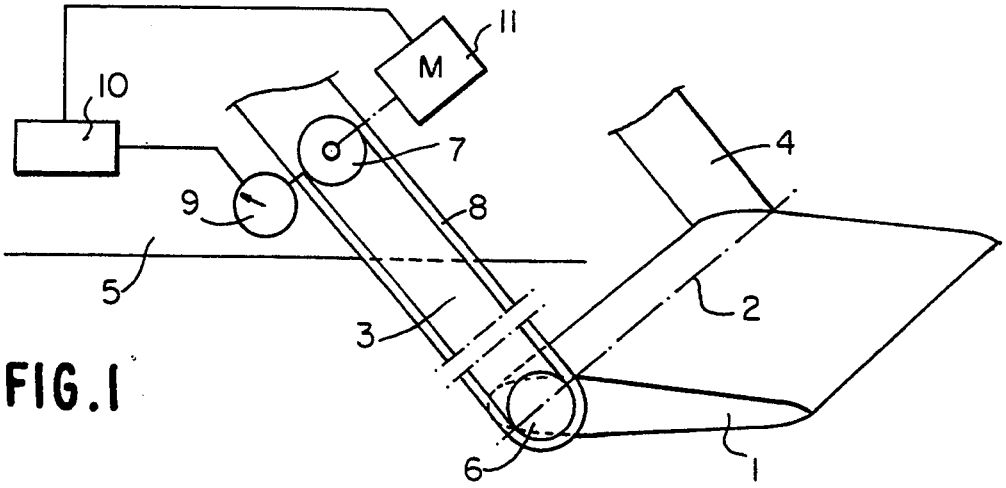
FIG. 1 shows an explanatory sketch of an embodiment of a propulsion device according to the invention.

FIG. 1 shows schematically an embodiment of a propulsion device according to the invention comprising a tilting element or wing 1 which is substantially horizontally disposed and is rotatably mounted about a suggested transversely extending shaft 2. The shaft 2 is placed at or somewhat ahead of the balance point for lift of the wing. At its ends the shaft is fixed to the lower ends of a pair of supporting arms 3, 4 which, at their other ends, are connected to the sides or the bottom of the topical watercraft 5 of which only a bottom contour is suggested in FIG. 1. The wing 1 is arranged so that, if necessary or desired, it can rotate 360° about the shaft. In the illustrated embodiment, the turning movement of the wing is transferred by means of a transmission consisting of a pulley on the wing, a driven pulley 7 mounted in the craft, and a chain or toothed belt 8.

The propulsion device is provided with a means which in operation, tries to return the wing 1 to its horizontal neutral position. In the illustrated embodiment, said means consists of a control loop connected to said chain or belt means 6–8. Thus, the pulley 7 at its axis is connected to a potentio-meter 9 delivering to a control circuit 10 a position signal indicating the excursion angle and direction of the wing. The control circuit 10 controls a torque motor 11 which can be a hydraulic or pneumatic motor or an electromotor, with or without a gearing. The motor 11 normally does not rotate a full revolution, but delivers a torque in one direction or the other, in order to try to pull the wing 1 towards it horizontal neutral position, with the leading edge of the wing pointing in the propulsion direction of the watercraft.

The control system is designed so as to be switchable, so that the motor exerts a torque to pull the wing towards its horizontal position, but now with the leading edge of the wing pointing aftwards in relation to the normal propulsion direction. The wing then constitutes a reversing device for the craft.

The fundamental operation of the wing or foil propeller will be further described with reference to FIGS. 2–5.

Figure 2:
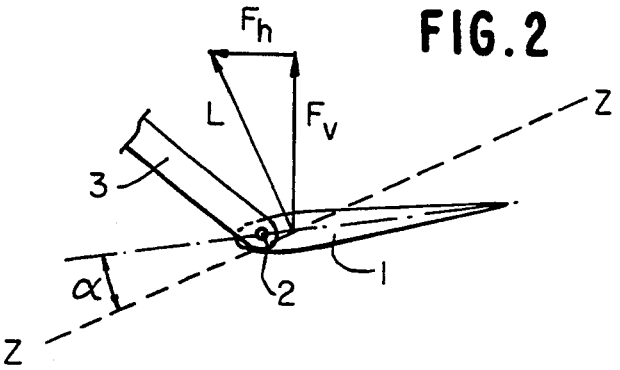
FIGS. 2 and 3 illustrate acting forces and appearing velocities, respectively, on movement of the wing downwards in surrounding water.
Figure 3:
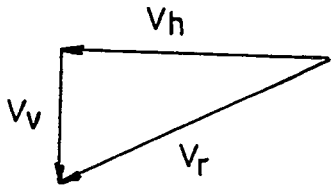

FIG. 2 shows the wing 1 with the shaft 2 and the supporting arm 3. If the supporting arms of the wing are attached to a vessel moving with a horizontal velocity $v_h$ and where the vessel also has a vertical velocity $v_v$, which may be due to pitching of the vessel at a given moment, one will have a resulting movement velocity $v_r$ for the wing, as shown in FIG. 3. The axis of the wing then will move along the line Z—Z in FIG. 2, wherein the line has the same direction as $v_r$.

If the wing is not subjected to applied spring forces, its chord will position itself in the direction of the water current if the tilting axis is placed ahead of the balance point for lift of the wing. With the above described torque motor system, however, the wing will be influenced by a torsional moment trying to pull the wing towards its horizontal neutral position. The wing therefore positions itself at an angle $\alpha$ to the water current, which angle is dependent on the magnitude of the torque. A too large torque will result in a stalling wing, with poor propulsion efficiency. A weak torque will result in a small angle of attack, so that the wing will not be completely utilized.

The angle of attack gives the wing a lifting force L which is perpendicular to the water current (the line Z—Z). This lifting force has a horizontal component $F_h$ and a vertical component $F_v$. These forces are transferred to the vessel, and the horizontal force is the propulsive force to which the vessel is subjected.

Figure 4:
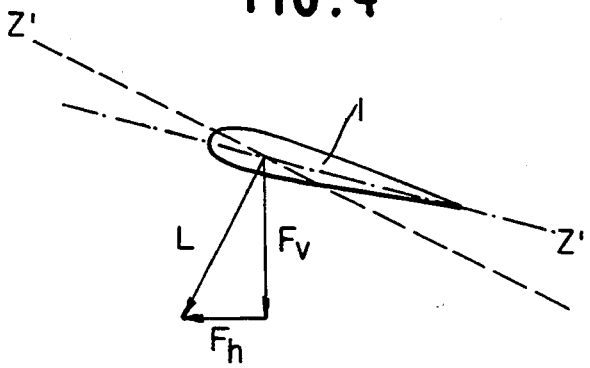
FIGS. 4 and 5 illustrate acting forces and appearing velocities, respectively, on movement of the wing upwards in surrounding water.
Figure 5:
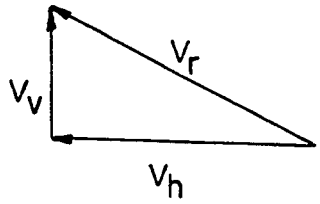

FIG. 4 shows the wing 1 on its way upwards in the water along the line Z'—Z' with a movement velocity $v_r$ (FIG. 5), the pitch movement of the vessel being directed upwards. The lifting force L then is reversed in relation to FIG. 2, but the horizontal force is still pointing forwards and gives propulsion to the vessel. The torque motor system now exerts a force in the opposite direction and still tries to move the wing towards its neutral position. As mentioned above, it is the position transmitter 9 which controls the torque motor 11 through the control circuit 10.

As mentioned, the wing 1 can be reversed 180° relative to the normal working direction shown in FIG. 1. This may be done by means of the afore-mentioned transmission means 6, 7, 8. This is also something which will happen if a vessel which is driven by a conventional screw propeller, and which does not use a wing or foil propeller as an auxiliary means of propulsion, reverses. The water flow then will exert a torsional force on the wing, so that it turns around.

The torque motor system trying to pull the wing towards its neutral position will necessarily consume energy. This energy consumption can be reduced by utilizing the actual water current for this purpose. An embodiment utilizing the water current in this manner, is shown schematically in FIGS. 6–7. FIGS. 6 and 7 show a catamaran type hull where a wing or foil propeller 12 is mounted astern between the hulls 13 and 14. In the side faces of the hulls adjacent to each end of the wing 12 there are provided a plurality of grooves or channels 15 and 16, respectively, extending parallel to the water surface. During speed, the water in these grooves will flow fairly parallel to the water surface, even if the water between the hulls 13 and 14 has a substantial vertical movement. At the ends of the grooves 15, 16 the water will hit the rearward wing tip of the wing 12. If the wing then as an angular excursion deviating from the horizontal position, the water current in the grooves will try to drive the wing back to a position parallel with the grooves.

In the embodiment according to FIGS. 6 and 7, grooves or channels are arranged at each end of the wing 12. However, they might possibly be arranged only at one end. Grooves or channels at one end of the wing may also be used in an embodiment wherein the wing is mounted at one side of an ordinary boat hull.

Trimming tabs placed at the rearward edge of the wing may also be an expedient for reducing the energy consumption of the torque motor. Such trimming tabs may be of a conventional type corresponding to that extensively used within the aircraft industry, and a further description of such trimming tabs therefore is considered to be unnecessary.

In FIG. 8 there is schematically shown an embodiment of a propulsion device according to the invention wherein the foil propeller is of the active type, i.e. it is used as a means of propulsion having motor power. In a similar manner as in the embodiment in FIG. 1, a wing 17 is kept in position by means of a carrier structure which is shown to consist of a pair of arms 18 (only one arm is shown), but the arms here are attached to a driving shaft 19 mounted at the rear end of a vessel 20. The shaft 19 is driven by a motor (not illustrated) giving the shaft a reciprocating turning movement within an angle region $\beta$. This gives the wing 17 an essentially vertical upward and downward movement. Combined with the control system described above, which system operates to maintain the wing in a horizontal neutral position, one will get a motor-driven propulsion system having a very high efficiency. The propulsion system can be reversed by means of the control system which pivots the wing through an angle of 180° between the supporting arms.

Instead of driving the carrier structure or supporting arms in said movement by means of motor power, the operation may be manual, by means of muscular strength.

FIGS. 9 and 10 show a further embodiment having an active motor-driven foil propeller device which is mounted on a vessel having a hull of the catamaran type. The illustrated embodiment comprises three foils or wings 21, 22, 23 which are rotatably mounted on a common rotor 24 at a suitable radial distance from the rotational axis of the rotor, so that each wing is freely rotatable 360° about its tilting axis. The rotor consists of a rotor shaft 25 mounted at its ends in a respective one of the catamaran hulls 26, 27, and which at each end has a carrier means 28 and 29, respectively, for the bearing points for the wings 21–23. In the illustrated embodiment, each of the carrier means 28 and 29 consists of three arms fixed to and projecting from the rotor shaft 25 with equal angular spacings, the wings being mounted at the outer ends of the arms. Instead, the carrier means might, for example, consist of suitable discs. The rotor 24 is rotated in the rotational direction shown in FIG. 10 by means of a motor 30, the motor being connected to the rotor through a suitable transmission which is shown to consist of a pulley 21 on the output shaft of the motor, a pulley 32 on the rotor shaft, and a driving belt 33. During rotation of the rotor, the wings 21–23 are moved around in a circular path, and thereby vertical driving movement of the wings is obtained, at the same time as they are pivoting freely on their respective rotational shafts.

It is a presupposition that the peripheral speed of the rotor 24 at the wings is less than the speed of the vessel through the water. The front or nose portions of the wings will then mainly point forwards. By means of this arrangement the propulsion of the vessel will be smooth, and the motor 30 will have a smooth or uniform load. The number of wings may be different from three, but the illustrated embodiment having three wings results in a relatively uniform load of the motor.

In FIGS. 9–10 there is not shown any reversing device. However, the driving device will also function in the rearward direction, with the same rotational direction of the rotor. However, the water current then firstly will have to be reversed by means of another device, for example by means of an auxiliary propeller of the conventional screw type.

What is claimed is:

1. A propulsion device for a watercraft (5; 20), comprising at least one essentially horizontally disposed, flat, thin, rigid wing (1; 17) which is rotatably connected to the craft (5;20) and is arranged to carry out a tilting movement to each side of a neutral position which is substantially parallel to a direction of movement of the watercraft, thereby providing propulsion for the craft by relative vertical movement between the wing (1;17) and the surrounding water, wherein the wing (1; 17) is mounted in such a manner as to be capable of turning 360° about its tilting axis (2), the tilting axis being located at or somewhat ahead of the balance point for lift of the wing (1;17), as viewed in the horizontal direction in which the craft is moving; and a means for returning the wing (1) towards the neutral position after said wing angularly deviates from the neutral position, wherein the returning means comprises a control system (10) which, under the influence of a signal from a position reference means (9), is arranged to influence a motor (11) exerting a torque on the wing (1) in the direction towards the neutral position.

2. A device according to claim 1, wherein the motor (11) is coupled to the tilting axis (2) of the (1 through a transmission system (6, 7, 8) and is arranged to turn the wing (1) through 180° to a position for reverse propulsion of the watercraft (5).

3. A device according to claim 2 wherein the position reference means is a potentiometer (9) which is connected to the transmission means (6, 7, 8).

4. A device according to claim 2, wherein the control system is switchable, to provide for return of the wing to the neutral position also in the reversing position thereof.

5. A device according to claim 1, further comprising a means for returning the wing (1) towards the neutral position after said wing angularly deviates from the neutral position, wherein the returning means comprises a number of grooves or channels (15, 16) arranged in a surface of a hull member (13, 14) immediately adjacent to at least an end portion of the wing (12), the grooves (15, 16) extending substantially parallel to the water surface, to guide wing-influencing water currents along the rear tip of the wing (12).

6. A device according to claim 1, characterized in that the wing (17) is mounted at one end of a carrier structure (18) which, at its other end, is connected to a driving means adapted to give the wing (17) an essentially vertical upward and downward movement, to effect active propulsion of the watercraft (20).

7. A device according to claim 6, characterized in that the carrier structure consists of a pair of arms (18) extending backwards from the watercraft (20) and carrying the wing (17) at their rear ends, the other ends of the arms being coupled to said driving means, this being adapted to give the arms (18) reciprocating angular movement.

8. A device according to claim 1, characterized in that it comprises a number of wings (21–23) which are rotatably mounted on a common rotor (24) at a radial distance from the rotational axis thereof, so that each wing is freely rotatable about its tilting axis, the rotor being rotatable by means of a motor (30).

9. A device according to claim 8, characterized in that the rotor (24) consists of a rotor shaft (25) which at each end has a carrier means (28, 29) projecting from the shaft and having bearing means for the respective wings (21–23) at suitable distance from the rotor shaft.

10. A propulsion device for a watercraft, comprising at least one essentially horizontally disposed, flat, thin, rigid wing which is rotatably connected to the craft and is arranged to carry out a tilting movement to each side of a neutral position which is substantially parallel to a direction of movement of the watercraft, thereby providing propulsion for the craft by relative vertical movement between the wing and the surrounding water, where in the wing is mounted in such a manner as to be capable of turning 360° about its tilting axis, the tilting axis being located at or somewhat ahead of the balance point for lift of the wing, as viewed in the horizontal direction in which the craft is moving; and a means for returning the wing towards the neutral position after said wing angularly deviates from the neutral position, wherein the returning means comprises a number of grooves or channels arranged in a surface of a hull member immediately adjacent to at leas an end portion of the wing, the grooves extending substantially parallel to the water surface, to guide wing-influencing water currents along the rear tip of the wing.

11. A propulsion device for a watercraft, comprising at least one essentially horizontally disposed, flat, thin, rigid wing which is rotatably connected to the craft and is arranged to carry out a tilting movement to each side of a neutral position which is substantially parallel to a direction of movement of the watercraft, thereby providing propulsion for the craft by relative vertical movement between the wing and the surrounding water, wherein the wing is mounted in such a manner as to be capable of turning 360° About its tilting axis, the tilting axis being located at or somewhat ahead of the balance point for lift of the wing, a viewed in the horizontal direction in which the craft is moving, said wing being mounted at one end of a carrier structure which, at its other end, is connected to a driving means that imparts to the wing a substantially upward and downward movement with respect to the direction of movement of the watercraft, to effect active propulsion of the watercraft, said carrier structure comprising a pair of arms extending backwards from the watercraft and carrying the wing at their rear ends, the other ends of said arms being coupled to said driving means, thereby imparting to said arms a reciprocating angular movement.

* * * * *